US008671727B2

(12) United States Patent
Toyoda et al.

(10) Patent No.: US 8,671,727 B2
(45) Date of Patent: Mar. 18, 2014

(54) METHODS FOR PRODUCING BLANK TUBE FOR COLD DRAWING AND FOR PRODUCING COLD DRAWN TUBE

(75) Inventors: Masatoshi Toyoda, Nishinomiya (JP); Keishi Matsumoto, Takarazuka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/528,155

(22) Filed: Jun. 20, 2012

(65) Prior Publication Data

US 2012/0263967 A1 Oct. 18, 2012

Related U.S. Application Data

(63) Continuation of application No. PCT/JP2010/007129, filed on Dec. 8, 2010.

(30) Foreign Application Priority Data

Dec. 21, 2009 (JP) ..... 2009-289604

(51) Int. Cl.

| | |
|---|---|
| ***B32B 1/08*** | (2006.01) |
| ***C23G 1/02*** | (2006.01) |
| ***B24C 1/04*** | (2006.01) |
| ***B32B 15/02*** | (2006.01) |
| ***B21C 1/22*** | (2006.01) |

(52) U.S. Cl.

USPC ..... 72/40; 72/41; 72/199; 72/274; 29/81.021; 451/39; 451/51; 216/8; 428/687

(58) Field of Classification Search

None

See application file for complete search history.

(56) References Cited

U.S. PATENT DOCUMENTS

| | | | | | |
|---|---|---|---|---|---|
| 3,160,533 | A | * | 12/1964 | Fischer | 148/567 |
| 3,487,674 | A | * | 1/1970 | Yasunaga et al. | 72/252.5 |
| 3,626,741 | A | * | 12/1971 | Ham | 72/253.1 |
| 4,783,378 | A | * | 11/1988 | Wakui et al. | 428/600 |
| 5,163,602 | A | * | 11/1992 | Usui | 228/143 |
| 6,165,640 | A | * | 12/2000 | Sugikawa | 429/166 |
| 6,748,786 | B2 | * | 6/2004 | Ooyauchi et al. | 72/370.14 |

(Continued)

FOREIGN PATENT DOCUMENTS

| | | | |
|---|---|---|---|
| JP | 55-158838 | * | 12/1980 |
| JP | 63-309325 | * | 12/1988 |

(Continued)

OTHER PUBLICATIONS

Machine translation of JP 2005-144479. Jun. 2005.*

*Primary Examiner* — John J Zimmerman
(74) *Attorney, Agent, or Firm* — Clark & Brody

(57) ABSTRACT

A blank tube for cold drawing is used for the production of a longer-length, small-diameter tube such as a heat-transfer tube for steam generation in nuclear power facilities, wherein the blank tube will not cause scoring and chattering vibration in a drawing process. The blank tube is used to produce a cold drawn tube through cold drawing of the blank tube. The average surface roughness Ra (ANSI B46.1) of the inner surface of blank tube before drawing satisfies the condition: 0.10 μm≤Ra≤1.00 μm in the case of a blank tube for cold drawing for use in an oil-lubricated drawing. In particular, the surface roughness Ra satisfies the condition: 0.10 μm≤Ra≤0.50 μm in the case of a blank tube for use in a high-pressure lubrication drawing and made of an austenitic alloy for use in a heat-transfer tube for a steam generator.

12 Claims, 1 Drawing Sheet

(56) References Cited

U.S. PATENT DOCUMENTS

| | | | | |
|---|---|---|---|---|
| 7,587,820 | B2 * | 9/2009 | Ooyauchi et al. | 29/890.038 |
| 8,490,452 | B2 * | 7/2013 | Harada et al. | 72/253.1 |
| 2002/0068108 | A1 * | 6/2002 | Iwaya | 425/399 |
| 2004/0055674 | A1 * | 3/2004 | Yazawa et al. | 148/610 |
| 2004/0244877 | A1 * | 12/2004 | Yokoi et al. | 148/320 |
| 2006/0240270 | A1 * | 10/2006 | Kuroda et al. | 428/472.2 |
| 2011/0219837 | A1 * | 9/2011 | Nishimori et al. | 72/41 |
| 2012/0047981 | A1 * | 3/2012 | Harada et al. | 72/253.1 |

FOREIGN PATENT DOCUMENTS

| | | | |
|---|---|---|---|
| JP | 64-18537 | * | 1/1989 |
| JP | 64-31956 | * | 2/1989 |
| JP | 64-83316 | * | 3/1989 |
| JP | 2-255213 | * | 10/1990 |
| JP | 3-285049 | * | 12/1991 |
| JP | 07-016642 | | 1/1995 |
| JP | 08-281333 | | 10/1996 |
| JP | 10-17963 | * | 1/1998 |
| JP | 10-114014 | * | 5/1998 |
| JP | 11-061301 | * | 3/1999 |
| JP | 2004-130325 | | 4/2004 |
| JP | 2005-144479 | | 7/2005 |
| JP | 2005-307273 | | 11/2005 |
| JP | 2006-045659 | * | 2/2006 |

* cited by examiner

METHODS FOR PRODUCING BLANK TUBE FOR COLD DRAWING AND FOR PRODUCING COLD DRAWN TUBE

TECHNICAL FIELD

The present invention relates to a blank tube for cold drawing and a method for producing the blank tube, and a method for producing a cold drawn tube. In particular, the present invention relates to a blank tube for cold drawing for use in the production of a heat-transfer tube for a steam generator in nuclear power facilities, and so on, in which the blank tube for cold drawing is not likely to cause scoring and chattering vibration in cold drawing, and a method for producing the blank tube for cold drawing, as well as a method for producing a cold drawn tube which is obtained through cold drawing of the blank tube.

It is noted that terms used in the present description are defined as follows unless otherwise stated.

"A heat-transfer tube for a steam generator" refers to a longer-length small-diameter heat-transfer tube which is used in a steam generator etc. in nuclear power facilities. In particular, a heat-transfer tube for a steam generator for nuclear power generation is referred to herein as an SG (steam generator) tube.

"A high-pressure lubrication drawing method" is a processing method in which a mother tube is inserted into a high-pressure container, and after the high-pressure container is filled with lubrication oil, and the lubrication oil is pressurized up to, for example, not less than 40 MPa by a booster machine, the tube is drawn with the inner and outer surfaces of the tube being forcedly lubricated.

"Scoring" is a phenomenon that a poor lubrication of the inner surface of the workpiece causes a sharp increase in friction due to the direct contact between the workpiece and a tool (a die and a plug), resulting in severe adhesion and the resultant surface roughening.

"Chattering vibration" is a stick-slip phenomenon in which a sticking state and a slipping state are repeated, and which is a self-induced vibration caused by fluctuation of friction coefficient which occurs between the workpiece and a tool (a die and a plug).

"Inner surface roughness Ra of blank tube" means the roughness of the inner surface of a blank tube represented by an average surface roughness Ra defined in ANSI B46.1.

BACKGROUND ART

Heat-transfer tubes which are incorporated and used in a steam generator in nuclear power facilities, and heat-transfer tubes which are incorporated in a heat exchanger in a feed water heater etc. of various equipments are produced as a longer-length tube having, for example, a small outer diameter of not more than 40 mm and a length of not less than 15 m. Such longer-length, small-diameter tubes are generally produced by preparing, as a starting material, a seamless tube which is produced in a hot working method using a Ugine Sejournet tube-making facility, and subjecting it to a bright heat treatment in a reducing atmosphere and thereafter a cold drawing.

It is common practice in cold drawing to form chemically treated lubricating films on the inner and outer surfaces of a blank tube after a heat treatment. However, when a chemically treated lubricating film is formed on a longer-length, small-diameter tube, care must be taken to ensure that the blank tube is sufficiently treated for the entire inner surface at the time of chemical treatment. Such a treatment requires huge man-hours, and chemicals used in the treatment are relatively expensive, thus resulting in incurring high operation costs. Further, in the case of Ni-based alloys (Inconel type alloys) used for SG tubes in nuclear power facilities, a problem arises that a chemically treated lubricating film is not likely to be formed on such a material.

For that reason, in recent years, an oil-lubricated drawing in which an oil lubricating film is formed on the inner and outer surfaces of the blank tube has been practiced. In this drawing method, chemicals are less expensive and the processing thereafter is relatively easier compared to the case of forming a chemically treated lubricating film.

Further, as an improved method categorized in the oil-lubricated drawing method in which an oil lubricating film is formed on the surface of the blank tube, a high-pressure lubrication drawing method (a high-pressure draw method) has been developed. The method stabilizes the drawing and achieves significant effects in improving the quality of the drawn tube by constantly supplying a high-pressure lubricating oil between the blank tube and a tool. This is a method of processing a tube in which a blank tube is placed inside a high-pressure container which is filled with a lubricating oil, and the blank tube is pulled outside the high-pressure container during which drawing is performed while feeding high-pressure lubricating oil.

FIG. 1 is a diagram to illustrate a high-pressure lubrication drawing method, in which drawing is performed while feeding high-pressure lubricating oil. In FIG. 1, when the drawing of a blank tube 3 is performed using a plug 1 and a die 2, a cylindrical container 4 of which one end is closed and an open end has a telescopic structure 4*a* is swingably provided with the closed end side being a fulcrum such that the open end side can be changed in orientation between a drawing pass line and a blank tube insertion line.

Penetratingly disposed in the container 4 is a plug supporting rod 5 for retaining the plug 1 such that the plug 1 is placed in the die 2 which is securedly disposed on the drawing pass line.

The blank tube 3 which has been subjected to a bright heat treatment is loaded in the container 4, and is set in a state where a pointed portion of the blank tube 3 is passed through an annular space formed by the die 2 and the plug 1 as shown in FIG. 1.

In this state, a high-pressure lubricating oil is fed to fill the container 4 by a pump P, the blank tube 3 is drawn through the annular space to outside the container 4 to be formed into a drawn tube having predetermined dimensions. Throughout the process of this drawing, the inner and outer surfaces of the blank tube 3 are continuously fed with the high-pressure lubricating oil which is fed to fill the container 4.

At this moment, the pressure tightness between the open end and the die 2 in the container 4 is automatically maintained as the result of that the telescopic structure 4*a* provided on the open end side in the container 4 is pressed in the left hand direction in the drawing by the high-pressure lubricating oil, and thereby the front end thereof is brought into pressure contact with the entrance side surface of the die 2. Further, the pressure tightness between the plug 1 and the die 2 is maintained by the blank tube 3 which is being drawn.

With this high-pressure lubricated drawing method, lubricating oil is fed to fill between the blank tube and the tool by high pressure, and therefore oil is not likely to run out during drawing, making it possible to substantially prevent scoring which is likely to occur in a typical oil-lubricated drawing. However, even when the high-pressure lubricated drawing method is adopted, there may be cases where scoring occurs locally and where chattering vibration occurs.

If scoring occurs during drawing, the surface quality of tube product degrades, leading to a decline in yield. Moreover, if chattering vibration occurs, the inner diameter of the tube product fluctuates, although by a very small amount, along the longitudinal direction. When such a tube product is used as an SG tube in nuclear power facilities, a rigorous inspection standard is set in eddy-current examination with inner coil method, and since the inner diameter fluctuation along the longitudinal direction generates a background noises, it will remarkably reduce the S/N ratio (S: signal from a flaw, N: noise) of the tube, being sentenced as nonconformance.

Regarding the prevention of occurrence of scoring and chattering vibration, various proposals have been made until now. For example, Patent Literature 1 describes a drawing method in which to prevent chattering vibration which occurs in a metal to be processed, a bright heat treatment in a hydrogen atmosphere having a dew point of −50° C. or less is applied to the workpiece before drawing. It is stated that suppressing the generation of chromium oxide ($Cr_2O_3$), alumina oxide ($Al_2O_3$) and the like during heat treatment makes it possible to restrain the fluctuation of the friction coefficient between the blank tube and the tool during drawing, thus preventing chattering vibration.

Patent Literature 2 describes a plug to be used for drawing work of a workpiece, which has been subjected to a lubrication treatment (a blank tube having been subjected to a bright heat treatment), wherein the surface roughness Rmax of an area that comes into contact with the workpiece is 0.4 to 2.0 μm, and a method for producing a drawn steel tube by using the plug. It is stated that since metal oxide is trapped in minute concave portions which are present on the plug surface, and fine powder of metal oxide that flows out thereof tends to cut the lubricating oil film, thereby increasing friction resistance and causing chattering vibration, the occurrence of chattering vibration can be prevented by appropriately adjusting the surface roughness of the plug to secure oil pits having sufficient capacity to harbor lubricating oil.

The technologies described in Patent Literatures 1 and 2 are respectively an effective method for preventing the occurrence of chattering vibration. However, the prior art is not necessarily perfect, when applied alone, and occasionally local scoring and chattering vibration happen to occur depending on the state of the inner surface of blank tube which is the workpiece, the state of formation of oil lubricating film, and the conditions of drawing, etc.

CITATION LIST

Patent Literature

Patent Literature 1: Japanese Patent Application Publication No. 2004-130325

Patent Literature 2: Japanese Patent Application Publication No. 2005-144479

SUMMARY OF INVENTION

Technical Problem

It is an object of the present invention to provide a blank tube for cold drawing for use in oil-lubricated drawing in which an oil lubricating film is formed on the surface of blank tube, particularly a blank tube for cold drawing for use in the production of longer-length, small-diameter heat-transfer tubes such as SG tubes used for a steam generator in nuclear power facilities, in which the blank tube for cold drawing is immune from causing scoring and chattering vibration in a drawing. It is another object of the present invention to provide a method for producing a blank tube for cold drawing of the present invention.

Solution to Problem

The summaries of the present invention are as follows.

(1) A blank tube for cold drawing for use in a drawing process in which an oil lubricating film is formed on a surface of the workpiece, wherein an inner surface roughness of blank tube before drawing, when represented by an average surface roughness Ra defined in ANSI B46.1, satisfies the below-described Formula (i):

$$0.10\ \mu m \leq Ra \leq 1.00\ \mu m. \quad \text{(i)}$$

(2) The blank tube for cold drawing according to the above-described (1), wherein the blank tube for cold drawing is a blank tube for use in a high-pressure lubrication drawing.

(3) The blank tube for cold drawing according to the above-described (2), wherein the blank tube for cold drawing is a blank tube made of an austenitic alloy for use in a heat-transfer tube for a steam generator for nuclear power generation.

(4) The blank tube for cold drawing according to the above-described (2) or (3), wherein the inner surface roughness of blank tube, when represented by an average surface roughness Ra defined in ANSI B46.1, satisfies the below-described Formula (ii):

$$0.10\ \mu m \leq Ra \leq 0.50\ \mu m. \quad \text{(ii)}$$

(5) A method for producing a blank tube for cold drawing according to any of the above-described (1) to (4), wherein the inner surface of blank tube before drawing is subjected to a blasting treatment by use of blast grains of #100 to #350 in microgrits classification defined in ISO 8486 1996 F standard.

(6) The method for producing a blank tube for cold drawing according to the above-described (4), wherein the inner surface of blank tube before drawing is subjected to a blasting treatment by use of blast grains of #200 to #350 in microgrits classification defined in ISO 8486 1996 F standard, the blast grains being made of zirconium oxides.

(7) The method for producing a blank tube for cold drawing according to any of the above-described (1) to (4), wherein the inner surface of blank tube before drawing is subjected to a pickling treatment with fluoronitric acid so that the inner surface roughness of blank tube is adjusted so as to satisfy the Formula (i) or the Formula (ii).

(8) A method for producing a cold drawn tube, wherein cold drawing is performed by using the blank tube for cold drawing according to any of the above-described (1) to (4), or the blank tube for cold drawing produced by the method according to any of the above-described (5) to (7).

Advantageous Effects of Invention

Applying a drawing method which forms an oil lubricating film on a surface of a blank tube to the blank tube for cold drawing of the present invention will make it possible to prevent the occurrence of scoring and chattering vibration which are likely to occur in the drawing. In particular, using the relevant blank tube for the production of a longer-length, small-diameter heat-transfer tube such as SG tubes used in a steam generator in nuclear power facilities, and applying a high-pressure lubrication drawing method will achieve significant effects.

According the method for producing a blank tube for cold drawing of the present invention, it is possible to appropriately adjust the inner surface roughness of the blank tube before drawing and obtain the blank tube for drawing of the present invention.

DESCRIPTION OF EMBODIMENTS

Figure 1:
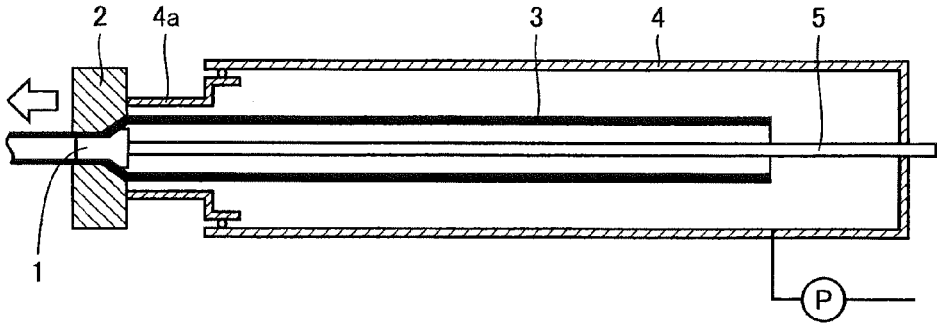
FIG. 1 is a diagram to illustrate a high-pressure lubrication drawing method for performing drawing while feeding high-pressure lubricating oil.

The blank tube for cold drawing of the present invention is premised to be a blank tube for drawing used in drawing in which an oil lubricating film is formed on the surface of the workpiece, in which the inner surface roughness of blank tube before drawing, when represented by the average surface roughness Ra defined in ANSI B46.1, satisfies the below-described Formula (i):

$$0.10\ \mu m \leq Ra \leq 1.00\ \mu m. \quad (i)$$

The reason why the inner surface roughness Ra of blank tube before drawing is defined to satisfy the Formula (i) is to prevent the occurrence of scoring and chattering vibration in drawing.

If the inner surface roughness Ra of blank tube before drawing is less than 0.10 μm, chattering vibration will occur when the drawing is performed. This is because, since the inner surface of the blank tube is smooth, the friction coefficient at the contact surface between the tool and the blank tube will decrease, but on the other hand, it becomes difficult for lubricating oil to sufficiently enter into between the metal and the tool (the die and the plug) so that the fluctuation of friction coefficient is more likely to occur.

If the inner surface roughness Ra of blank tube before drawing exceeds 1.00 μm, scoring will occur. When the roughness Ra of the surface is large, it is inevitable that local scoring occurs even if a high-pressure lubrication drawing method in which the drawing is performed while feeding high-pressure lubricating oil is adopted.

FIG. 2 is a diagram to illustrate a situation where scoring occurs in a high-pressure lubricated drawing, in which A shows the case where the inner surface roughness of blank tube before drawing is large, and B shows the case where the inner surface roughness Ra of blank tube is small. This diagram shows an enlarged portion where the outer diameter of the workpiece (blank tube) 3 is reduced by a die (not shown) and the inner surface thereof comes into contact with the plug. An outlined arrow in the diagram shows the direction in which the blank tube 3 is drawn.

Figure 2A:
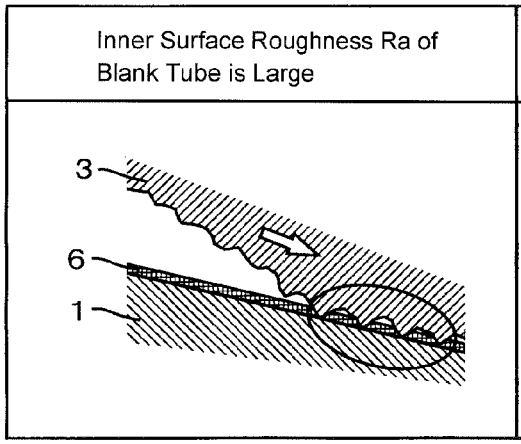
FIG. 2 is a diagram to illustrate a situation where scoring occurs in a high-pressure lubricated drawing, in which A shows the case where the inner surface roughness of blank tube before drawing is rough, i.e., large in Ra, and B shows the case where the inner surface roughness of blank tube is fine, i.e. small in Ra.
Figure 2B:
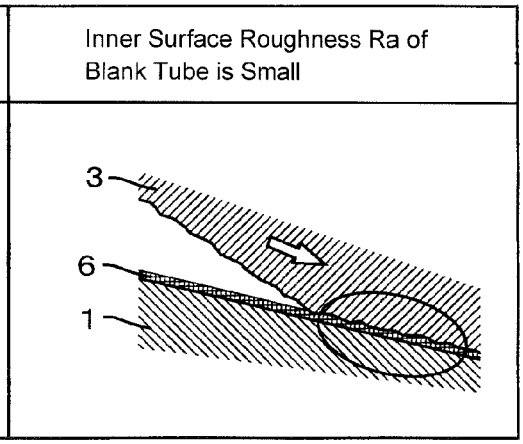

As shown in FIG. 2, an oil film 6, which is caused by a high-pressure lubricating oil forcedly introduced into between the tool and the blank tube, is formed on the surface of the plug 1. As shown in FIG. 2B, when the inner surface roughness Ra of the blank tube 3 is small, since there are no protrusions on the surface of the blank tube 3, and the entire metal is pressed toward the surface of the plug 1 by the die, the blank tube 3 and the plug 1 will never come into a direct contact with each other.

In contrast to this, as shown in FIG. 2A, when the inner surface roughness Ra of the blank tube 3 is large, there are many protrusions (convex portions) on the surface of the blank tube 3 where a part of the convex portion on the surface is likely to directly come into contact with the plug 1, penetrating through the oil film 6. Therefore, it is speculated that local scoring may occur.

Although the blank tube for cold drawing of the present invention is a blank tube for drawing which can be used both in an ordinary oil-lubricated drawing and a high-pressure lubrication drawing, preferable is to adopt an embodiment in which the blank tube for drawing is used for a high-pressure lubrication drawing. When a high-pressure lubrication drawing method is applied, since lubricating oil will be fed to fill between the blank tube and the tool by high pressure as described above, there will be no case where oil locally runs out and gets exhausted during drawing.

The blank tube for cold drawing of the present invention (the blank tube to which the high-pressure lubrication drawing method is applied) can adopt an embodiment in which the relevant blank tube is a blank tube made of an austenitic alloy which is used in heat-transfer tubes for a steam generator. A heat-transfer tube for a steam generator refers to a longer-length, small-diameter tube such as SG tubes which are incorporated and used in a steam generator in nuclear power facilities, and heat-transfer tubes which are incorporated in a heat exchanger such as a feed water heater, etc.

The blank tube made of an austenitic alloy of the present invention preferably has a chemical composition consisting of, for example, in mass %, C, 0.15% or less, Si: 1.00% or less, Mn: 2.0% or less, P: 0.030% or less, S: 0.030% or less, Cr: 10.0 to 40.0%, Ni: 8.0 to 80.0%, Ti: 0.5% or less, Cu: 0.6% or less, Al: 0.5% or less, and N: 0.20% or less, the balance being Fe and impurities.

Among the above-described austenitic alloys, a Ni-based alloy of Inconel type which has excellent corrosion resistance and heat resistance is more preferable. Exemplifying a specific chemical composition, a Ni-based alloy has a composition consisting of, in mass %, C, 0.15% or less, Si: 1.00% or less, Mn: 2.0% or less, P: 0.030% or less, S: 0.030% or less, Cr: 10.0 to 40.0%, Ni: 45.0 to 80.0%, Ti: 0.5% or less, Cu: 0.6% or less, and Al: 0.5% or less, the balance being Fe and impurities.

Typical compositions of the Ni-based alloy to be used for the SG tubes are the following two kinds: (a) and (b).

(a) A Ni-based alloy (15% Cr-9% Fe-75% Ni) defined in ASME SB-163 UNS N006600 is an alloy having excellent corrosion resistance in an environment including chlorides since it contains 14.0 to 17.0 mass % of Cr and 70 to 80 mass % of Ni. A more specific chemical composition includes a composition consisting of, in mass %, C, 0.15% or less, Si: 1.00% or less, Mn: 2.0% or less, P: 0.030% or less, S: 0.030% or less, Cr: 14.0 to 17.0%, Fe: 6.0 to 10.0%, Ti: 0.5% or less, Cu: 0.6% or less, and Al: 0.5% or less, the balance being Ni and impurities.

(b) A Ni-based alloy (30% Cr-9% Fe-60% Ni) defined in ASME SB-163 UNS N006690 is an alloy having excellent corrosion resistance in an environment including chlorides, as well as in a pure water and an alkali environment at high temperatures since it contains 27.0 to 31.0 mass % of Cr and 55 to 65 mass % of Ni. A more specific chemical composition includes a composition consisting of, in mass %, C, 0.06% or less, Si: 1.00% or less, Mn: 2.0% or less, P: 0.030% or less, S: 0.030% or less, Cr: 27.0 to 31.0%, Fe: 7.0 to 11.0%, Ti: 0.5% or less, Cu: 0.6% or less, and Al: 0.5% or less, the balance being Ni and impurities.

In the blank tube for cold drawing (a blank tube made of an austenitic alloy for use in the heat-transfer tubes for a steam generator for nuclear power generation) of the present invention, it is preferable that the inner surface roughness of blank tube, when represented by an average surface roughness Ra defined in ANSI B46.1, satisfies the below-described Formula (ii) since, if so, chattering vibration and scoring, for example, even minute scoring having no effect on quality can be prevented more securely.

$$0.10\ \mu m \leq Ra \leq 0.50\ \mu m \quad \text{(ii)}$$

In the above-describe Formula (ii), the reason why the upper limit of the average surface roughness Ra is set to 0.50 μm is because chattering vibration and scoring can be prevented more securely, and in addition to that, it is specified for SG tubes used in nuclear power facilities to have smoother surface as being less than 0.50 μm in Ra. Setting the upper limit of the inner surface roughness Ra of blank tube for the production of SG tubes to 0.50 μm enables to prevent the occurrence of even minute scoring without any impact to the quality during drawing, and to finish the inner surface roughness Ra of the SG tube, which is produced by using this blank tube, less than 0.50 μm.

The method for producing a blank tube for cold drawing of the present invention is the above-described method for producing a blank tube for cold drawing of the present invention, in which the inner surface of blank tube before drawing is subjected to a blasting treatment by use of blast grains of #100 to #350 in microgrits classification defined in ISO 8486 1996 F standard.

The blank tube for cold drawing of the present invention, particularly, the blank tube for cold drawing to be used for the production of a heat-transfer tube for a steam generator (for example, SG tubes) in nuclear power facilities is typically produced by preparing a seamless tube produced by a hot production method by use of a Ugine Sejournet tube-making facility as the starting material, and subjecting the same to a bright heat treatment and thereafter to cold rolling to yield a blank tube for drawing which has a due outer diameter and wall thickness, allowing the cold drawing to be applied thereto. The blank tube for cold drawing thus obtained is subjected to drawing by means of a high-pressure lubrication drawing method to produce a heat-transfer tube for a steam generator such as SG tubes.

The inner surface roughness of the above-described blank tube for cold drawing, as cold-rolled, varies depending on the wear condition of the rolling roll, and the setup conditions of mandrel, rolls, and so on, so local scoring and chattering vibration happen to occur even if the high-pressure lubrication drawing should be applied to such a blank tube for cold drawing.

Accordingly, in the method for producing a blank tube for cold drawing of the present invention, the inner surface of blank tube before drawing is subjected to a blasting treatment to adjust the inner surface roughness of the blank tube. As the blast grains, those defined by ISO standard and represented by microgrits classification number are used. In the blast grains of each classification number, the proportion of grain diameters to be contained therein is determined, and the roughness of the inner surface of blank tube can be adjusted within a predetermined roughness range respectively by the size number of the blast grains to be used.

By subjecting the inner surface of blank tube before drawing to a blasting treatment by using blast grains of #100 to #350 in microgrits classification defined in ISO 8486 1996 F standard, it is possible to produce a blank tube for drawing, in which the inner surface roughness Ra of blank tube satisfies the Formula (i).

As the blast grains, what are generally used such as alumina grains may be used. When a blank tube made of a high alloy such as a Ni-based alloy is to be processed, zirconium oxide grains are preferable.

Meanwhile, when the blasting treatment is performed in case of blank tubes for the production of SG tubes used in nuclear power facilities, it is required that zirconium oxide grains are used. Further, since the upper limit of the inner surface roughness Ra of an SG tube is specified to be 0.50 μm, when the blank tube for the production of an SG tube is to be processed, it is preferable that a blasting treatment is performed by using zirconium oxide grains of such microgrits classification that should ensure the upper limit of the inner surface roughness Ra of blank tube to be 0.50 μm.

In this case, as the method for producing a blank tube for cold drawing of the present invention, it is preferable to adopt an embodiment in which the inner surface of blank tube before drawing is subjected to a blasting treatment by using blast grains made of zirconium oxides of #200 to #350 in microgrits classification defined in ISO 8486 1996 F standard. By employing this method, it becomes possible to surely finish the inner surface roughness Ra of blank tube to be not more than 0.50 μm as shown in Table 2 of Example 2 to be described below.

The blasting treatment can be performed according to a common method, for example, by injecting blast grains at an air pressure of 0.29 to 0.49 MPa (3 to 5 kgf/cm$^2$) for duration of 3 to 10 minutes by using an air jet machine.

Another method for producing a blank tube for cold drawing of the present invention is a method for producing the above-described blank tube for cold drawing of the present invention in which the inner surface of blank tube before drawing is subjected to a pickling treatment with fluoronitric acid to adjust the inner surface roughness of the blank tube so as to satisfy the Formula (i) or Formula (ii).

The reason why the inner surface of blank tube before drawing is subjected to a pickling treatment is to ensure the inner surface roughness Ra of blank tube to satisfy the Formula (i) or Formula (ii). Since subjecting the inner surface of a blank tube to a pickling treatment with fluoronitric acid will cause surficial grain boundaries to be ditched to thereby roughen the surface, this method is applicable to a blank tube whose inner surface roughness Ra is less than 0.10 μm.

The pickling treatment is conveniently performed by a method of immersing the blank tube in a pickling solution. It is preferable that the concentration of fluoric acid (HF) is 2 to 5% and the concentration of nitric acid ($HNO_3$) is 5 to 10% in the pickling solution. If the concentrations of the acid solution are within theses ranges, it is possible to make the treatment proceed at an appropriate speed under around room temperature. The treatment temperature is preferably 30 to 50° C. Further, regarding the time of immersion into the acid solution, the necessary time for the inner surface roughness Ra of blank tube to satisfy the Formula (i) or Formula (ii) according to the material grade of the blank tube, the concentration and temperature of pickling solution, and the like may be grasped in advance, and based on this, the immersion time may be determined as necessary.

According to the method for producing a blank tube for cold drawing of the present invention, it is possible to produce a blank tube for cold drawing of the present invention with the inner surface roughness of the blank tube before drawing being appropriately adjusted. Further, since according to the production method of a cold drawn tube of the present invention, the obtained blank tube for cold drawing of the present invention is subjected to drawing, the method is optimal for the production of heat-transfer tubes for a steam generator in nuclear power facilities, and the like.

EXAMPLES

Example 1

Targeting a blank tube of a Ni-based alloy (Inconel type alloy: 30% Cr, 9% Fe, 60% Ni) having an outer diameter of 25.0 mm, a wall thickness of 1.65 mm, and a length of 11400 mm, blank tubes having various levels of inner surface roughness Ra were prepared. The inner surface roughness Ra of blank tube was made to vary by subjecting the blank tube before drawing to a blasting treatment. For the roughness measurement of the inner surface of tube, SV-3100S4 made by Mitutoyo Corporation was used.

These blank tubes were drawn into a longer-length, small-diameter tubes (hereafter, referred to as drawn tubes) having an outer diameter of 19.14 mm, a wall thickness of 1.14 mm, and a length of 21700 mm at a lubrication oil pressure of 120 Mpa according to the high-pressure lubrication drawing method shown in the FIG. 1.

The drawn tubes thus obtained were subjected to an investigation of the occurrence of chattering vibration and scoring. As for chattering vibration, its occurrence or nonoccurrence was evaluated by performing eddy-current examination with inner coil method, and an evaluation criterion: SN ratio≤20 was used to evaluate the occurrence of chattering vibration. As for scoring, as far as inner surface scoring concerns, its occurrence or nonoccurrence was evaluated through comparison with a scoring sample by visual observation.

Investigation results are shown in Table 1. "Minute" in the "scoring" column of Table 1 means that minute scoring without any impact to quality has occurred. Moreover, the meanings of the symbols in the "evaluation" column are as follows.

◎ shows that neither chattering vibration nor scoring occurred.

○ shows that although neither chattering vibration nor scoring occurred, minute scoring without any impact to quality occurred.

x shows that either of or both chattering vibration and scoring occurred.

TABLE 1

| Test No. | Inner surface roughness Ra of blank tube | Chattering vibration | Scoring | Evaluation |
|---|---|---|---|---|
| 1 | 0.04 | Occurred | None | X |
| 2 | 0.08 | Occurred | None | X |
| 3 | 0.14 | None | None | ◎ |
| 4 | 0.25 | None | None | ◎ |
| 5 | 0.33 | None | None | ◎ |
| 6 | 0.46 | None | None | ◎ |
| 7 | 0.42 | None | None | ◎ |
| 8 | 0.31 | None | None | ◎ |
| 9 | 0.50 | None | None | ◎ |
| 10 | 0.62 | None | Minute | ○ |
| 11 | 0.71 | None | Minute | ○ |
| 12 | 0.85 | None | Minute | ○ |
| 13 | 0.98 | None | Minute | ○ |
| 14 | 1.05 | None | Occurred | X |
| 15 | 1.32 | None | Occurred | X |

The results shown in Table 1 revealed the followings. Chattering vibrations occurred when the inner surface roughness Ra of blank tube before drawing was small (Test Nos. 1 and 2). This is inferred that when the inner surface roughness Ra of blank tube was small and smooth, the friction coefficient between the tool and the blank tube had decreased, so that slipping became more likely to occur. On the other hand, scoring occurred when the inner surface roughness Ra of blank tube before drawing was large and rough (Test Nos. 14 and 15).

In Test Nos. 3 to 13, of which inner surface roughness Ra of blank tube satisfied the definition of the present invention (corresponding to an Inventive Example of the present invention), neither chattering vibration nor scoring having impact to quality occurred. In particular, when the inner surface roughness Ra of blank tube before drawing was 0.10 to 0.50 μm (Test Nos. 3 to 9), neither chattering vibration nor minute scoring occurred, and tubes with better quality were obtained.

Example 2

Targeting a blank tube having the same material grade and dimensions as those of the blank tube of the Ni-based alloy (Inconel type alloy) used in Example 1, blank tubes having various inner surface roughness Ra were prepared. These blank tubes were subjected to a blasting treatment by using blast grains of different microgrits classification, and the inner surface roughness Ra of blank tube after the treatment was measured. For the roughness measurement of the inner surface of tube, SV-3100S4 made by Mitutoyo Corporation was used.

In the blasting treatment, zirconium oxide grains were used and blasted onto the inner surface of blank tube at an air pressure of $3.9\times10^5$ Pa (4 kgf/cm$^2$) and for duration of 5 min by an air jet machine.

The results of roughness measurement of the inner surface of tube before and after blasting are shown in Table 2. These blank tubes which had been subjected to the blasting treatment were drawn by a high-pressure lubrication drawing method, similarly to that in Example 1. The drawn tubes thus obtained were subjected to an investigation for the occurrence of chattering vibration and scoring.

Investigation results are shown in Table 2. "Minute" in the "scoring" column of Table 2 means that minute scoring without any impact to quality has occurred. Moreover, the meanings of the symbols in the "evaluation" column are as follows.

◎ shows that neither chattering vibration nor scoring occurred.

○ shows that although neither chattering vibration nor scoring occurred, minute scoring without any impact to quality occurred.

x shows that either of or both chattering vibration and scoring occurred.

TABLE 2

| Test No. | Classification No. | Roughness Ra before blasting (μm) | Roughness Ra after blasting (μm) | Chattering vibration | Scoring | Evaluation |
|---|---|---|---|---|---|---|
| 1 | #50 | 0.23 | 1.44 | None | Occurred | X |
| 2 | #50 | 0.54 | 1.07 | None | Occurred | X |
| 3 | #50 | 0.09 | 1.88 | None | Occurred | X |
| 4 | #100 | 0.17 | 0.77 | None | Minute | ○ |
| 5 | #100 | 0.45 | 0.94 | None | Minute | ○ |
| 6 | #100 | 0.56 | 0.65 | None | Minute | ○ |
| 7 | #200 | 0.05 | 0.49 | None | None | ◎ |
| 8 | #200 | 0.37 | 0.35 | None | None | ◎ |
| 9 | #200 | 0.61 | 0.41 | None | None | ◎ |
| 10 | #350 | 0.08 | 0.21 | None | None | ◎ |
| 11 | #350 | 0.29 | 0.35 | None | None | ◎ |
| 12 | #350 | 0.55 | 0.19 | None | None | ◎ |

The results shown in Table 2 revealed the followings.

[Roughness Ra after Blasting]

When blasting treatment was performed by using zirconium oxide grains of #50 in microgrits classification (Test Nos. 1 to 3), the inner surface roughness Ra of blank tube after blasting exceeded 1.00 μm. As the classification number increases from #100, #200, and to #350, the inner surface roughness Ra of blank tube became smaller in a stepwise manner. In Test Nos. 4 to 12 (corresponding to the Inventive Example of the present invention) in which blasting treatment was performed by using zirconium oxide grains of #100 to #350 in microgrits classification, it was possible to make the inner surface roughness Ra of blank tube to be within a range defined in the present invention (0.10 to 1.00 μm which satisfies the Formula (i)). Further, in Test Nos. 7 to 12 in which blasting treatment was performed by using zirconium oxide grains of #200 to #350 in microgrits classification, it was possible to make the inner surface roughness Ra of blank tube to be within a range of 0.10 to 0.50 μm which satisfies the Formula (ii).

[Evaluation after Drawing]

When the inner surface roughness Ra of blank tube after blasting exceeded 1.00 μm (Test Nos. 1 to 3), the scoring occurred. When the inner surface roughness Ra of blank tube was made to be 0.10 to 1.00 μm by the blasting treatment (Test Nos. 4 to 12), neither chattering vibration nor scoring having impact to quality occurred. In particular, when the inner surface roughness Ra of blank tube after blasting was 0.10 to 0.50 μm (Test Nos. 7 to 12), neither chattering vibration nor minute scoring occurred, and tubes with better quality were obtained.

Example 3

Targeting a blank tube having the same material and dimensions as those of the blank tube of the Ni-based alloy (Inconel type alloy) used in Example 1, blank tubes having an inner surface roughness Ra of less than 0.10 μm were prepared. These blank tubes were subjected to a pickling treatment, and the measurement of the inner surface roughness Ra of blank tube after treatment was performed.

In the pickling treatment, the above-described blank tubes were immersed in a fluoronitric acid solution containing 4.5% of HF and 9.5% of $HNO_3$, held at 25° C., and the immersion time was varied.

The results of measurement of the roughness of the inner surface of tube before and after pickling are shown in Table 3. These blank tubes, which had been subjected to pickling treatment, were drawn by a high-pressure lubrication drawing method, similarly to that in Example 1. The drawn tubes thus obtained were subjected to an investigation for the occurrence of chattering vibration and scoring.

Investigation results are shown in Table 3. "Minute" in the "scoring" column of Table 3 means that minute scoring without any impact to quality has occurred. Moreover, the meanings of the symbols in the "evaluation" column are as follows.

- ◎ shows that neither chattering vibration nor scoring occurred.
- ○ shows that although neither chattering vibration nor scoring occurred, minute scoring without any impact to quality occurred.
- x shows that either of or both chattering vibration and scoring occurred.

TABLE 3

| Test No. | Immersion time (min) | Roughness Ra before pickling (μm) | Roughness Ra after pickling (μm) | Chattering vibration | Scoring | Evaluation |
|---|---|---|---|---|---|---|
| 1 | 20 | 0.07 | 0.06 | Occurred | None | X |
| 2 | 60 | 0.05 | 0.15 | None | None | ◎ |
| 3 | 120 | 0.09 | 0.35 | None | None | ◎ |
| 4 | 240 | 0.06 | 0.55 | None | Minute | ○ |
| 5 | 360 | 0.03 | 0.75 | None | Minute | ○ |
| 6 | 480 | 0.05 | 1.05 | None | Occurred | X |
| 7 | 600 | 0.08 | 1.45 | None | Occurred | X |

The results shown in Table 3 revealed the followings.

[Roughness Ra after Pickling]

When immersion time was 20 min (Test No. 1), pickling was insufficient and there was no remarkable change observed in the roughness of the inner surface of blank tube before and after pickling. Moreover, when immersion time was 480 min and 600 min (Test Nos. 6 and 7), over-pickling occurred and the roughness Ra of the inner surface of blank tube exceeded 1.00 μm. When the immersion time was made to be within a range of 60 to 360 min (Test Nos. 2 to 5 which correspond to the Inventive Example of the present invention), it was possible to make the inner surface roughness Ra of blank tube be within the range defined in the present invention. That is, under the above-described fluoronitric acid concentrations and temperature conditions, the treatment time may be set to 60 to 360 min

[Evaluation after Drawing]

When the inner surface roughness Ra of blank tube after pickling was small and smooth (Test No. 1), the friction coefficient between the tool and the blank tube decreased, and slipping became more likely to occur causing chattering vibration. On the other hand, when the inner surface roughness Ra of blank tube after pickling exceeded 1.00 μm (Test No. 6 and 7), the scoring occurred.

In contrast to this, when the inner surface roughness Ra of blank tube after pickling was made to be 0.10 to 1.00 μm (Test Nos. 2 to 5), neither chattering vibration nor scoring having impact to quality occurred. In particular, when the inner surface roughness Ra of blank tube after pickling was 0.10 to 0.50 μm (Test Nos. 2 and 3), neither chattering vibration nor minute scoring occurred so that tubes with better quality were obtained.

INDUSTRIAL APPLICABILITY

The blank tube for cold drawing of the present invention, and the method for producing the blank tube, and the method for producing a cold drawn tube can be effectively used for the production of a longer-length, small-diameter tube such as a heat-transfer tube for a steam generator (SG tube) for nuclear power generation, and the like.

REFERENCE SIGNS LIST

1: Plug,
2: Die,
3: Workpiece (blank tube),
4: Container,
4*a*: Telescopic structure,
5: Plug supporting rod
6: Oil film

What is claimed is:

1. A method for producing a cold drawn tube, wherein cold drawing is performed for a heat-transfer tube for a steam generator for nuclear power generation the method comprising:

subjecting a starting material which is produced in a hot working method to a bright heat treatment;

cold rolling the starting material to produce a workpiece which has an outer diameter and wall thickness for cold drawing to be applied thereto;

subjecting an inner surface of the workpiece to a blasting treatment by use of blast grains of #100 to #350 in microgrits classification defined in ISO 8486 1996 F standard to provide a blank tube for cold drawing in which an inner surface roughness of the blank tube before drawing, when represented by an average surface roughness Ra defined in ANSI B46.1, satisfies formula (i) below; and forming an oil lubricating film on a surface of the workpiece and performing a high-pressure lubrication drawing;

$$0.10\ \mu m \leq Ra \leq 1.00\ \mu m \quad \text{(i)}.$$

2. The method for producing a cold drawn tube according to claim 1, wherein the blank tube for cold drawing has a chemical composition consisting of, in mass %, C: 0.15% or less, Si: 1.99% or less, Mn: 2.0% or less, P: 0.030% or less, S: 0.030% or less, Cr: 10.0 to 40.0%, Ni: 45.0 to 80.0%, Ti: 0.5% or less, Cu: 0.6% or less, and Al: 0.5% or less, the balance being Fe and impurities.

3. A method for producing a blank tube for cold drawing, wherein the blank tube before drawing is provided with an oil lubrication film on a surface thereof and the blank tube is used in a high-pressure lubrication drawing, the method comprising:

subjecting a starting material which is produced in a hot working method to a bright heat treatment;

cold rolling the starting material to produce a workpiece which has an outer diameter and wall thickness for cold drawing to be applied thereto;

subjecting an inner surface of the workpiece to a blasting treatment by use of blast grains of #100 to #350 in microgrits classification defined in ISO 8486 1996 F standard to obtain the blank tube before drawing, wherein the inner surface roughness of the blank tube before drawing, when represented by an average surface roughness Ra defined in ANSI B46.1, satisfies formula (i) below, $$0.10\ \mu m \leq Ra \leq 1.00\ \mu m \quad \text{(i)}.$$

4. A method for producing a blank tube for cold drawing, wherein the blank tube before drawing is provided with an oil lubrication film on a surface thereof and the blank tube is used in a high-pressure lubrication drawing, the method comprising:

subjecting a starting material which is produced in a hot working method to a bright heat treatment;

cold rolling the starting material to produce a workpiece which has an outer diameter and wall thickness for cold drawing to be applied thereto;

subjecting an inner surface of the workpiece to a blasting treatment by use of blast grains of #200 to #350 in microgrits classification defined in ISO 8486 1996 F standard, the blast grains being made of zirconium oxide, to obtain the blank tube before drawing, wherein the inner surface roughness of the blank tube before drawing, when represented by an average surface roughness Ra defined in ANSI B46.1, satisfies formula (ii) below, $$0.10\ \mu m \leq Ra \leq 0.50\ \mu m \quad \text{(ii)}.$$

5. The method for producing a blank tube for cold drawing according to claim 4, wherein the blank tube for cold drawing has a chemical composition consisting of, in mass %, C: 0.15% or less, Si: 1.99% or less, Mn: 2.0% or less, P: 0.030% or less, S: 0.030% or less, Cr: 10.0 to 40.0%, Ni: 45.0 to 80.0%, Ti: 0.5% or less, Cu: 0.6% or less, and Al: 0.5% or less, the balance being Fe and impurities.

6. A method for producing a blank tube for cold drawing, wherein the blank tube before drawing is provided with an oil lubrication film on a surface thereof and the blank tube is used in a high-pressure lubrication drawing, the method comprising:

subjecting a starting material which is produced in a hot working method to a bright heat treatment;

cold rolling the starting material to produce a workpiece which has an outer diameter and wall thickness for cold drawing to be applied thereto; and subjecting an inner surface of the workpiece to a pickling treatment with fluoronitric acid to obtain the blank tube before drawing; and wherein the inner surface roughness of blank tube before drawing when represented by an average surface roughness Ra defined in ANSI B46.1, satisfies formula (i) below, $$0.10\ \mu m \leq Ra \leq 1.00\ \mu m \quad \text{(i)}.$$

7. A method for producing a cold drawn tube, wherein cold drawing is performed for a heat transfer tube for a steam generator for nuclear power generation the method comprising:

subjecting a starting material which is produced in a hot working method to a bright heat treatment;

cold rolling the starting material to produce a workpiece which has an outer diameter and wall thickness for cold drawing to be applied thereto;

subjecting an inner surface of the workpiece to a blasting treatment by use of blast grains of #200 to #350 in microgrits classification defined in ISO 8486 1996 F standard, the blast grains being made of zirconium oxide, to provide a blank tube for cold drawing in which an inner surface roughness of the blank tube before drawing, when represented by an average surface roughness Ra defined in ANSI B46.1, satisfies formula (ii) below, and forming an oil lubricating film on a surface of the workpiece and performing a high-pressure lubrication drawing;

$$0.10\ \mu m \leq Ra \leq 0.50\ \mu m \quad \text{(ii)}.$$

8. The method for producing a cold drawn tube according to claim 7, wherein the blank tube for cold drawing has a chemical composition consisting of, in mass %, C: 0.15% or less, Si: 1.99% or less, Mn: 2.0% or less, P: 0.030% or less, S: 0.030% or less, Cr: 10.0 to 40.0%, Ni: 45.0 to 80.0%, Ti: 0.5% or less, Cu: 0.6% or less, and Al: 0.5% or less, the balance being Fe and impurities.

9. A method for producing a blank tube for cold drawing, wherein the blank tube before drawing is provided with an oil lubrication film on a surface thereof and the blank tube is used in a high-pressure lubrication drawing, the method comprising:

subjecting a starting material which is produced in a hot working method to a bright heat treatment;

cold rolling the starting material to produce a workpiece which has an outer diameter and wall thickness for cold drawing to be applied thereto; and subjecting an inner surface of the workpiece to a pickling treatment with fluoronitric acid to obtain the blank tube before drawing, wherein the inner surface roughness of the blank tube before drawing, when represented by an average surface roughness Ra defined in ANSI B46.1, satisfies formula (i) or formula (ii) below, $$0.10\ \mu m \leq Ra \leq 1.00\ \mu m \quad \text{(i), or}$$

$$0.10\ \mu m \leq Ra \leq 0.50\ \mu m \quad \text{(i).}$$

10. The method for producing a blank tube for cold drawing according to claim 9, wherein the blank tube for cold drawing has a chemical composition consisting of, in mass %, C: 0.15% or less, Si: 1.99% or less, Mn: 2.0% or less, P: 0.030% or less, S: 0.030% or less, Cr: 10.0 to 40.0%, Ni: 45.0 to 80.0%, Ti: 0.5% or less, Cu: 0.6% or less, and Al: 0.5% or less, the balance being Fe and impurities.

11. A method for producing a cold drawn tube, wherein cold drawing is performed for a heat transfer tube for a steam generator for nuclear power generation, the method comprising:

subjecting a starting material which is produced in a hot working method to a bright heat treatment;

cold rolling the starting material to produce a workpiece which has an outer diameter and wall thickness for cold drawing to be applied thereto; and subjecting an inner surface of the workpiece to a pickling treatment with fluoronitric acid to obtain the blank tube before drawing I in which an inner surface roughness of blank tube before drawing, when represented by an average surface roughness Ra defined in ANSI B46.1, satisfies formula (i) below, forming an oil lubricating film on a surface of the workpiece and performing a high-pressure lubrication drawing;

$$0.10\ \mu m \leq Ra \leq 1.00\ \mu m \quad \text{(i).}$$

12. A method for producing a blank tube for cold drawing, wherein the blank tube before drawing is provided with an oil lubrication film on a surface thereof and the blank tube is used in a high-pressure lubrication drawing, the method comprising:

subjecting a starting material which is produced in a hot working method to a bright heat treatment;

cold rolling the starting material to produce a workpiece which has an outer diameter and wall thickness for cold drawing to be applied thereto; and subjecting an inner surface of the workpiece to a pickling treatment with fluoronitric acid to obtain the blank tube before drawing, wherein the inner surface roughness of the blank tube before drawing when represented by an average surface roughness Ra defined in ANSI B46.1, satisfies formula (ii) below, $$0.10\ \mu m \leq Ra \leq 0.50\ \mu m \quad \text{(ii).}$$

* * * * *